US006344623B1

(12) United States Patent
Yamazaki et al.

(10) Patent No.: US 6,344,623 B1
(45) Date of Patent: Feb. 5, 2002

(54) MEMBRANE SWITCH AND PRODUCTION METHOD THEREOF

(75) Inventors: Sekiya Yamazaki; Noriyuki Yoshida, both of Nagoya; Takafumi Uemiya, Osaka; Yutaka Fukuda, Osaka; Misako Osoegawa, Osaka, all of (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 09/486,749

(22) PCT Filed: Apr. 21, 1999

(86) PCT No.: PCT/JP99/02132

§ 371 Date: Mar. 2, 2000

§ 102(e) Date: Mar. 2, 2000

(87) PCT Pub. No.: WO00/02217

PCT Pub. Date: Jan. 13, 2000

(30) Foreign Application Priority Data

Jul. 3, 1998 (JP) ..... 10-202833

(51) Int. Cl.[7] ..... H01H 1/10
(52) U.S. Cl. ..... 200/512; 178/18
(58) Field of Search ..... 178/18–20; 200/5 A, 200/512–517, 511; 340/272; 400/472, 473, 479, 477

(56) References Cited

U.S. PATENT DOCUMENTS

| | | | | |
|---|---|---|---|---|
| 3,911,215 A | | 10/1975 | Hurst et al. | 178/18 |
| 4,694,126 A | * | 9/1987 | Aiken, Jr. et al. | 200/5 A |
| 4,707,570 A | * | 11/1987 | Ide et al. | 178/18 |
| 4,864,084 A | * | 9/1989 | Cardinale | 200/5 A |
| 4,882,460 A | | 11/1989 | Mertens | 200/512 |
| 5,265,904 A | | 11/1993 | Shelton et al. | 280/731 |
| 5,334,976 A | * | 8/1994 | Wang | 341/22 |
| 5,973,282 A | * | 10/1999 | Takemori et al. | 200/512 |

FOREIGN PATENT DOCUMENTS

| | | |
|---|---|---|
| JP | 4280013 | 10/1992 |
| JP | 6060765 | 3/1994 |
| JP | 6076433 | 3/1994 |

* cited by examiner

*Primary Examiner*—Michael Friedhofer
(74) *Attorney, Agent, or Firm*—Smith, Gambrell & Russell, LLP.

(57) ABSTRACT

A membrane switch comprising a pair of electrode plates and a spacer separating the plates, wherein the operating force required to operate the membrane switch by pressing it with a rod having a hemispherical tip with a radius of curvature of 5 mm is within the range of 0.03 to 0.2 kg. The spacer is in the form of a film, the film has through holes, and the aperture ratio of the through holes is 50% or above. The effect is that a membrane switch exhibiting no malfunction, negligible variation in the operating force, and excellent in durability can be obtained.

2 Claims, 4 Drawing Sheets

(A)

(B)

(A)

(B)

MEMBRANE SWITCH AND PRODUCTION METHOD THEREOF

TECHNICAL FIELD

The present invention relates to an improvement of a switch for an on-vehicle horn.

More particularly, it is directed to the provision of a membrane switch for an on-vehicle horn that does not malfunction, exhibits negligible variation operating force, and is excellent in durability.

BACKGROUND ART

Conventionally, a switch for an on-vehicle horn, especially a membrane switch, basically comprises, as shown in FIG. 4, a pair of electrode plates 12 having an insulating film 13 placed thereon (for example, a polyester film with a conducting metal such as aluminum evaporated thereon, or copper foil) and a spacer (for example, a polyester film) 11 interposed between the electrode plates at a predetermined distance 14, in which connection terminals 15 for lead wires or the like are attached to the electrode plates 12 and electrically connected to the vehicle body side.

Known examples of such membrane switches include: (i) a type in which the spacer is made of foam plastics (U.S. Pat. No. 4,882,460); (ii) a type in which the spacer is provided in the interior surface of the outer cover (U.S. Pat. No. 5,265,904); and (iii) a type in which the spacer is constituted of projections (dots) 16 formed on an electrode plate 12 by printing with a thermosetting resin ink as shown in FIG. 5.

FIG. 4 is a sectional view showing a typical structure of a membrane switch.

FIG. 5 is a schematic diagram showing the structure of a spacer comprising a conventional membrane switch.

Referring to FIGS. 4 and 5, reference numeral 11 denotes a spacer, 12 denotes an electrode plate, 13 denotes an insulating film (base plate), 14 denotes a gap, 15 denotes a connection terminal, and 16 denotes a printed-dot spacer.

(i) When the spacer is made of foam material, there is such a danger that its height of the spacer is gradually reduced by repeated load applied thereon and its operating force is thereby changed and therefore results in the drawback of deficient durability.

(ii) When the spacer is provided on the surface of the outer cover, its operating force varies with the position of the push given thereon because the distances between the projections, serving as the spacer, are large.

(iii) When the spacer is provided with printed projections:

(A) variations in the operating force are caused by variations in the height of the dotted objects;

(B) a malfunction tends to occur such that the switch becomes contacted, while it is expected to be separated, because the printed dots cannot be made sufficiently high; and (C) the fabrication process becomes complicated because, in addition to the formation of the printed dots, provision of an adhesive layer on the circumference of the electrode is required to laminate two electrodes.

DISCLOSURE OF THE INVENTION

The inventors, after various investigations of the above mentioned problems, found that a membrane switch which has no malfunction, small variation in the operating force, and is excellent in durability can be provided by giving, in a membrane switch, a specific thickness to the spacer and a specific size to the through hole in the spacer to thereby keep the operating force within a predetermined range and, thus, completed the present invention.

Namely, the invention:

(1) provides a membrane switch comprising a pair of conductive electrode plates confronting each other and a spacer separating the same, wherein the operating force required to operate the switch by pressing it with a round rod having a hemispherical tip with a radius of curvature of 5 mm is within the range of 0.03 to 0.2 kg; and (2) it is also characterized in that the spacer is in the form of a film, the film has through holes, and the aperture ratio of the through holes is 50% or above. It further (3) provides a method of fabricating the membrane switch mentioned in (1) or (2) in which the operating force is kept within the range of 0.03 to 0.2 kg by setting the thickness of the spacer and the size of the through hole in the spacer to predetermined values;

(4) it is also characterized in that the thickness of the spacer is 20–150 $\mu$m and the size of one through hole in the spacer is 2–10 mm square; and (5) it is also characterized in that an insulating film with a predetermined thickness and having predetermined through holes made therein is used as the spacer.

Referring to the drawings, the invention is described below in concrete terms.

The present invention basically is a membrane switch comprising a pair of conducting electrode plates disposed confronting each other and a spacer inserted therebetween, wherein the operating force required to operate the membrane switch by pressing it with a round rod with a hemispherical tip having a radius of curvature of 5 mm is within the range of 0.03 to 0.2 kg, or preferably within the range of 0.05 to 0.15 kg.

As the spacer, it is preferable to use an insulating film with specific through holes made therein.

In this case, when the operating force is less than 0.03 kg, a malfunction tends to occur such that the conducting electrode plates are still electrically in contact to each other even if the switch is released to be off. When it exceeds 0.2 kg, a malfunction tends to occur such that the line is not conducting even if the switch is pressed to be on. Either case is not desirable.

While the portion other than the through holes of the insulating film serves as the spacer, it is preferred that the pair of confronting conducting electrode plates are insulated from each other by the spacer when the membrane switch is not pressed and they become definitely conducting when the membrane switch is pressed to blow the horn. However, the spacer, especially the shape of the through hole, is not limited to the shape shown in the figure, but that in a circular, elliptical, polygonal, and other shape can be suitably used.

In the invention, by setting the thickness of the spacer and the size of the through hole to predetermined values, a membrane switch having an operating force of 0.03–0.2 kg, without no malfunction and excellent in durability can be provided.

Accordingly, to keep the operating force within 0.03–0.2 kg, it is preferred that the thickness of the spacer be set to 20–150 μm, or more preferably to 25–125 μm, and the size of the through hole, when it is for example of a square shape, be set to 2–10 mm square, or more preferably to 2.5–8 mm square.

The operating force can be decreased according to enlarging the aperture ratio of the through hole in the spacer.

However, insofar that the spacer must maintain insulation between electrode plates, portions other than the through holes must be left. Therefore, an aperture ratio of 50% to 80% is preferable. The pitch distance of the through holes is normally 0.5–2.0 mm, or preferably 1.0–1.5 mm.

BRIEF DESCRIPTION OF THE DRAWINGS

FIG. 3-(B) is a sectional view of the membrane switch of Example 7.

Referring to FIGS. 1—3 reference numeral 1 denotes a spacer, 2 denotes copper foil, 3 denotes a base film, 4 denotes an adhesive, 5 denotes a through hole, 6 denotes a hot melt adhesive, 7 denotes an insulating film, and 8 denotes a margin to paste up.

Referring to FIGS. 4 and 5, reference numeral 11 denotes a spacer, 12 denotes an electrode plate, 13 denotes an insulating film (base plate), 14 denotes a gap, 15 denotes a connection terminal, and 16 denotes a printed dot spacer.

BEST MODE FOR CARRYING OUT THE INVENTION

The present invention is described in detail as related to the following examples, which, however, do not limit the scope of the present invention.

EXAMPLE 1

Figure 1:
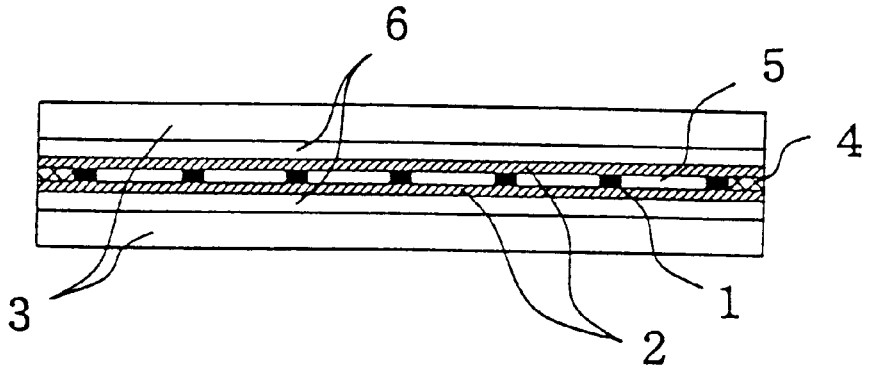
FIG. 1-(A) is a sectional view of a membrane switch of Example 1 and FIG. 1-(B) is a schematic diagram showing the structure of the spacer in Example 1.
Figure 1:
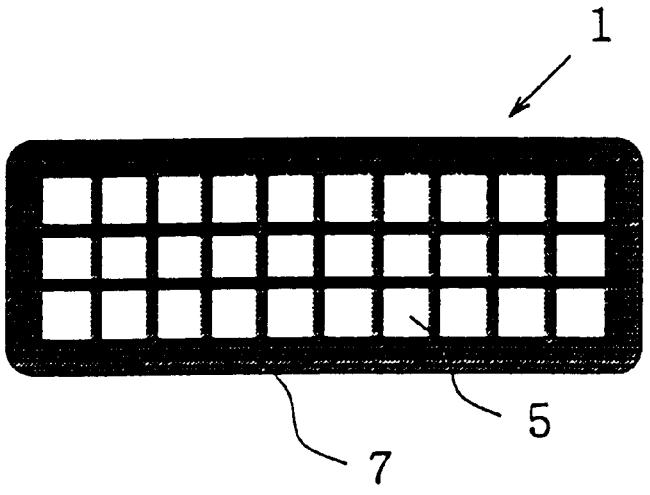

As shown in FIG. 1, a copper foil of 35 μm thickness (100 mm×50 mm) 2 was laminated onto a base material (100 mm×50 mm) 3 made of a 125 μm-thickness PET (LUMILAR manufactured by Toray Industries, Inc.) which was coated with a 50 μm-thick layer of a polyolefin-based hot-melt adhesive 6 by bonding them together by thermocompression to produce a base plate. A sheet (90 mm×40 mm) of a 50 μm thickness PET film (Toray Inc. made "Lumirror") with grating-shaped through holes (5 mm×5 mm) 5 made therein at a pitch width of 6 mm, used as the spacer 1, was sandwiched between two sheets of the base plates, with the copper foil side turned inward, and further, with an adhesive film (NITTO DENKO Inc. made "No. 5911") 4 placed on the circumference of the spacer 1, they were bonded by thermocompression and, thus, a membrane switch was fabricated.

A push rod having a hemispherical tip with a radius of curvature of 5 mm was placed on the surface of the membrane switch and a load was applied to the push rod and, thereby, the load to operate the switch was measured as the operating force.

To test the durability of the switch, it was pressed with a constant force (normally, 100 g/cm2) 10,000 times and, thereafter, the one exhibiting no malfunction and a small change in the operating force (within 20% or so) was taken as a good one.

The results are shown in Table 1.

TABLE 1

| | Example 1 | Example 2 | Example 3 | Example 4 | Example 5 | Example 6 | Example 7 |
|---|---|---|---|---|---|---|---|
| Spacer Material | PET Film | PET Film | PET Film | PET Film | PET Film | PET Film | PET Film |
| Spacer Thickness | 50 μm | 50 μm | 50 μm | 25 μm | 125 μm | 50 μm | 50 μm |
| Aperture Ratio | 69% | 51% | 79% | 69% | 69% | 69% | 69% |
| Operating Force | 0.1 kg | 0.13 kg | 0.05 kg | 0.05 kg | 0.15 kg | 0.1 kg | 0.1 kg |
| Durability | Good | Good | Good | Good | Good | Good | Good |

EXAMPLE 2

The same processes as in Example 1 were performed except that the size of the through hole in Example 1 was set to 2.5 mm×2.5 mm. The results are shown in Table 1.

EXAMPLE 3

The same processes as in Example 1 were performed except that the size of the through hole in Example 1 was set to 8 mm×8 mm. The results are shown in Table 1.

EXAMPLE 4

The same processes as in Example 1 were performed except that the thickness of the PET film in Example 1 was set to 25 μm. The results are shown in Table 1.

EXAMPLE 5

The same processes as in Example 1 were performed except that the thickness of the PET film in Example 1 was set to 125 μm. The results are shown in Table 1.

EXAMPLE 6

Figure 2:
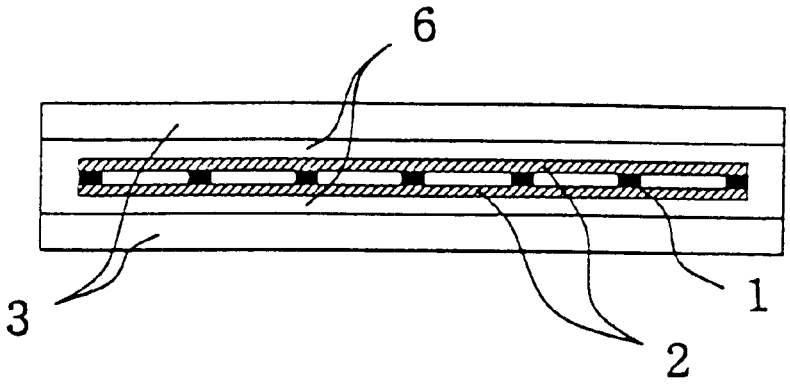
FIG. 2 is a sectional view of the membrane switch of Example 6.

As shown in FIG. 2, a base plate was produced by thermocompression bonding a 35 μm thickness copper foil (90 mm×40 mm) 2 onto a PET film base material (100 mm×50 mm) 3 coated with the adhesive as in Example 1.

The same spacer 1 as in Example 1 was placed on the copper foil and the two electrode plates 2 were thermocompression bonded therewith. The results are shown in Table 1.

EXAMPLE 7

Figure 3:
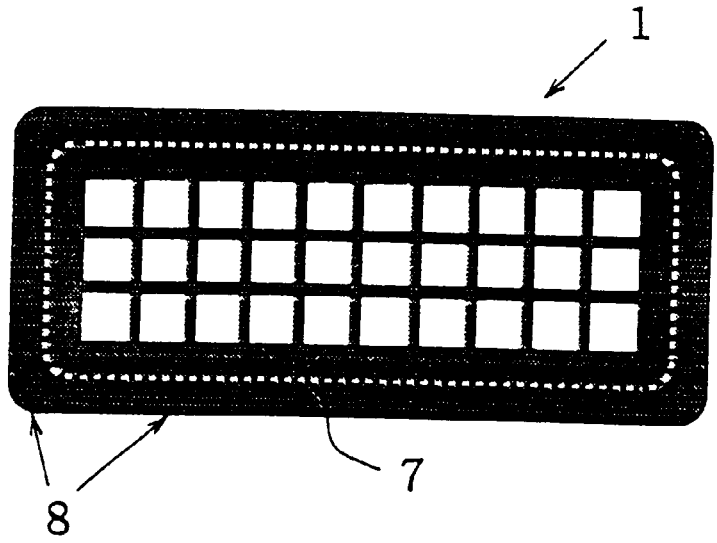
FIG. 3-(A) is a schematic diagram showing structure of the spacer of Example 7.
Figure 3:
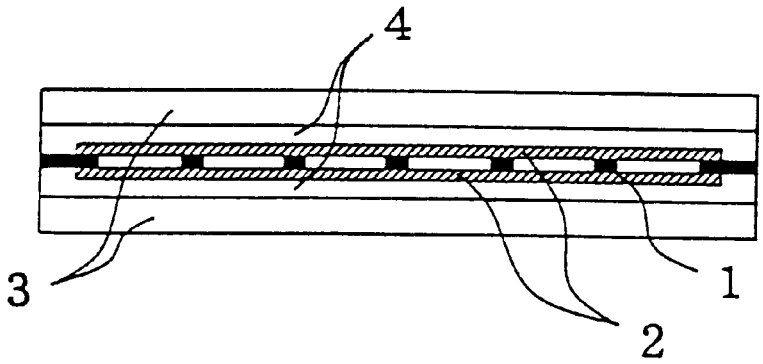
Figure 4:
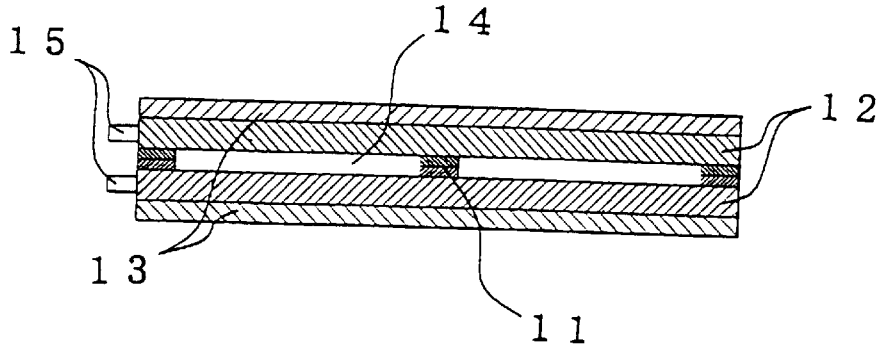
FIG. 4 PRIOR ART
FIG. 4 is a sectional view showing a typical structure of the membrane switch.
Figure 5:
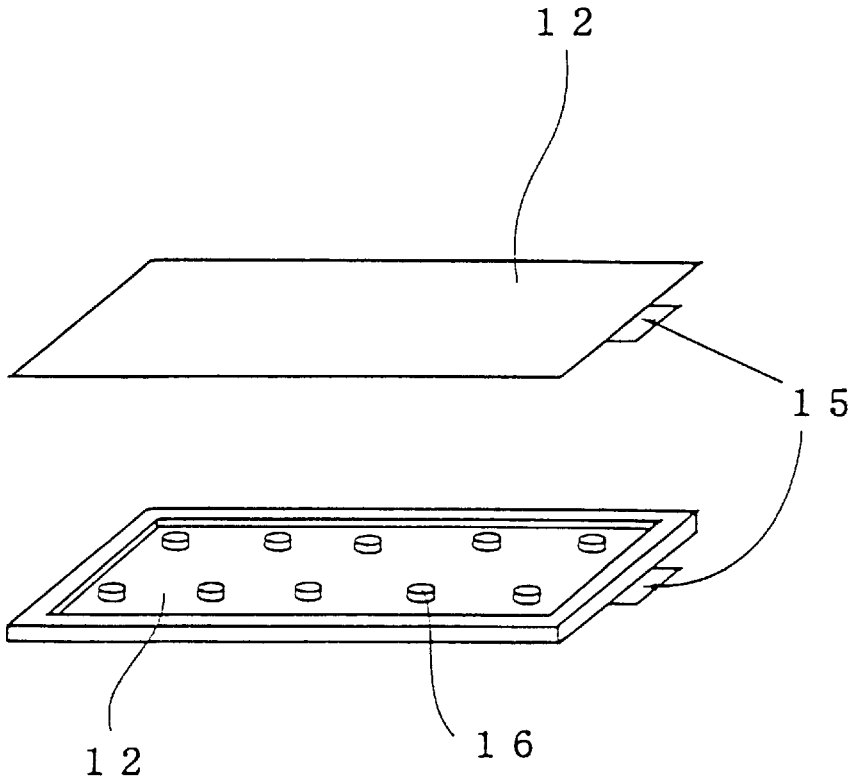
FIG. 5 PRIOR ART
FIG. 5 is a schematic diagram explanatory of the structure of the spacer constructing a conventional membrane switch.

As shown in FIG. 3, a 50 μm-thick PET film (100 mm×50 mm) having through holes of 5 mm×5 mm formed at a pitch of 6 mm in the center area (90 mm×40 mm) with the margin 8 left for applying paste, was sandwiched, as a spacer 1, between the same base plates as in Example 6 and they were bonded together thermocompression. The results are shown in Table 1.

COMPARATIVE EXAMPLE 1

Dot-like projections were printed with urethane-acrylate base UV-cure ink on the copper foil of the base plate in Example 1, and then, an adhesive layer was provided on the circumference of the copper foil and the base plate was laminated with the other unprinted base plate by thermo compression bonding.

The drawback of the resulting product was that the inter-electrode distance was insufficient and the switch did not get off immediately when a press on the membrane switch was released.

COMPARATIVE EXAMPLE 2

The same processes as in Example 1 were performed except that the thickness of the PET film in Example 1 was set to 12 μm and the size of the through hole was set to 2.5 mm×2.5 mm.

The drawback of resulting product was that the inter-electrode distance was insufficient and the switch did not extinguish immediately when a press on the membrane switch was released.

COMPARATIVE EXAMPLE 3

The same processes as in Example 1 were performed except that the thickness of the PET film in Example 1 was set to 188 μm and the size of the through hole was set to 8 mm×8 mm.

As a result, the operating force became as high as 0.35 kg and was accompanied by a problem of a malfunction of the membrane switch not conducting even if it was pressed to be on.

EXAMPLE 4

The same processes as in Example 1 were performed except that the size of the through hole in the PET film in Example 1 was set to 1.7 mm×1.7 mm.

As a result, the operating force became as high as 0.23 kg and was accompanied by a problem of a malfunction of the membrane switch not conducting even if it was pressed to be on.

EXAMPLE 5

The same processes as in Example 1 were performed except that the spacer in Example 1 was replaced with a polyurethane foam film of a thickness of 200 μm.

The obtained result was accompanied by a problem of considerable variation of its operating force while the operation to press the switch was repeated, i.e., it was deficient in durability.

According to the present invention, as described in the foregoing, a membrane switch exhibiting no malfunction, negligible variation in the operating force, and excellent in durability can be obtained.

What is claimed is:

1. A membrane switch comprising a pair of conductive electrode plates confronting each other and a spacer separating the electrode plates, wherein an operating force required to operate the membrane switch by pressing the conductive electrode plates together corresponds to a force exerted by a round rod having a hemispherical tip with a radius of curvature of 5 mm at a range of 0.03 to 0.2 kg; and wherein the spacer is in a form of a film having through holes at aperture to spacer ratio of 50% or more.

2. The membrane switch according to claim 1, wherein the spacer has a thickness of 20 to 150 μm and has through holes each having a size of 2 to 10 mm square.

* * * * *